US005408797A

United States Patent [19]

Bellem

[11] Patent Number: 5,408,797

[45] **Date of Patent: * Apr. 25, 1995**

[54] MID-ROOF ANCHORING SYSTEM

[75] Inventor: Norman A. Bellem, Lee's Summit, Mo.

[73] Assignee: Butler Manufacturing Company, Grandview, Mo.

[ * ] Notice: The portion of the term of this patent subsequent to Jun. 21, 2011 has been disclaimed.

[21] Appl. No.: 217,105

[22] Filed: Mar. 24, 1994

Related U.S. Application Data

[62] Division of Ser. No. 82,299, Jun. 28, 1993, Pat. No. 5,321,927.

[51] Int. Cl.[6] ..... E04D 1/34

[52] U.S. Cl. ..... 52/545; 52/520; 52/537; 52/573.1; 52/747

[58] Field of Search ..... 52/520, 528, 537, 542, 52/573.1, 747, 545

[56] References Cited

U.S. PATENT DOCUMENTS

| | | | |
|---|---|---|---|
| Re. 33,563 | 4/1991 | Heckelsberg | 52/520 X |
| 3,193,973 | 7/1965 | Lee et al. | 52/747 |
| 3,858,373 | 1/1975 | Day et al. | 52/520 X |
| 4,099,357 | 7/1978 | Lester | 52/747 X |
| 4,554,773 | 11/1985 | Conley | 52/747 X |
| 4,759,165 | 7/1988 | Getoor et al. | 52/747 X |
| 5,321,927 | 6/1994 | Bellem | 52/545 |

FOREIGN PATENT DOCUMENTS

| | | | |
|---|---|---|---|
| 3524367 | 1/1987 | Germany | 52/520 |

*Primary Examiner*—Carl D. Friedman
*Assistant Examiner*—Kevin D. Wilkens
*Attorney, Agent, or Firm*—Shoemaker and Mattare, Ltd.

[57] ABSTRACT

A mid-roof anchoring system includes a series of anchoring channels secured to the roof structure along a line midway between the eave and the ridge of the roof. Metal roof panels installed over tile substructure are permitted to float laterally on the roof, except where they are attached to the anchoring channels. As a result, the roof panels expand or contract in both directions away from the midway line. This approach minimizes thermally induced movement the upper and lower edges of the roof, and minimizes reaction forces at the anchor.

5 Claims, 5 Drawing Sheets

MID-ROOF ANCHORING SYSTEM

This is a division of application Ser. No. 082,299, filed Jun. 28, 1993, now U.S. Pat. No. 5,321,927.

BACKGROUND OF THE INVENTION

This invention relates generally to building construction, and more particularly to a mid-roof anchoring system for large metal roofs.

When designing a metal roof, one has to allow for thermal expansion, since roof temperature can vary substantially, during the course of a year, from the coldest annual temperature for the locale to a temperature well above (because of radiant heating by tile sun) the highest annual temperature. Linear growth of a particular roof span is proportional to span length, so expansion problems become more acute as roof size increases.

For a metal roof of modest size, the roof covering may be affixed to the substructure along one edge thereof, for example along the eave, and allowed to shrink or grow elsewhere. The roof may be secured to the substructure, other than at the fixed edge, by clips which permit sliding movement between the covering and the substructure. Butler Manufacturing's MR-24 clips, for example, permit two and one-half inches of movement, i.e., one and a quarter inches either way from a neutral position. The upper edges of the roof move with respect to the roof ridge line as the roof expands and contracts. The ridge is covered by a ridge cap, which may comprise a U-shaped element which can bend to accommodate roof expansion. Flexible weather seals may be provided at the inter face.

For large roof spans (that is, continuous panel runs not interrupted by thermal expansion joints), on the order of 200 to 300 feet, depending on the geographic location, movement of the free edge of the roof may exceed the design limits of the attachment clips. One way to overcome this problem is to break the roof span into two separate spans having a step or lap joint, like very large shingles. The uppermost span is secured along the step, and expands toward the roof ridge line, and the lowermost span is affixed along the eave. Where the spans overlap, the lower span slides or "floats" beneath the other.

A problem with stepped roofs is that of weather sealing, particularly leak prevention, at the lap joints. While excellent weather seals exist, it would be simpler, cheaper and better to be able to provide a large roof with long continuous spans, so that steps were not required.

As shown in FIG. 1, a typical metal building includes an array of vertical members 10, interconnected by substantially horizontal beams 12, and supporting a roof substructure 14. The roof substructure includes a series of parallel main frames or trusses 16, or their functional equivalent, each running from the roof ridge 18 to an cave 20. The main frames, in turn, support parallel purlins 22, or their equivalent, each running parallel to the ridge line and eaves. The main frames and purlins may be continuous or segmented, probably the latter for the large roofs.

The purlins are covered by metal panels 24, which are seamed edge-to-edge, by rolling their edges 26 together. The panels are conventionally held to the roof by clips 30 (see FIG. 5) which permit some lengthwise movement of the panels as they expand and contract with respect to the substructure. The clips 30 may be of the type shown in U.S. Pat. No. 4,543,760, which is incorporated by reference. Each of these clips has a sliding element with sheet metal tabs 28 which are rolled into the roof seam as it is formed.

The edges of the panels are raised substantially, FIG. 4, so that the completed roof is in a sense corrugated. Reference may be made to U.S. Pat. No. 4,559,753 for a more thorough description of the panels, and to U.S. Pat. No. 4,989,308 for a description of an apparatus for forming the seams in situ. Both patents are incorporated herein by reference.

Optionally, a layer of insulation 32 may be laid over the purlins, before the roof panels are installed.

If such a construction is used for very large buildings, roof expansion may produce movement exceeding the design limits of the attachment clips: a stepped or overlapped assembly of separate panel spans (see FIG. 2) is then ordinarily required, but such an expedient is objectionable from several standpoints, including the cost of additional parts, and problems with long term leak prevention, snow catching and vapor retarder integrity.

SUMMARY OF THE INVENTION

An object of the invention is to permit the construction of large continuous-span roofs. A related object is to accommodate thermal expansion in such roofs.

These and other objects are attained by providing a roof span, comprising a substructure formed from an array of structural members and a metal roof covering formed of interconnected metal panels, with means for immovably affixing the roof covering to the substructure only within a narrow zone intermediate two edges of tile roof span.

The invention also provides a method of securing a metal roof covering to a roof substructure in such a way as to minimize thermally induced movement of the span, that is, to control the maximum movement of any edge of the roof panel. This objective is accomplished by immovably fixing the roof covering to tile substructure only within a zone intermediate two edges of the roof span.

The present invention solves tile thermal expansion problem for very large roofs by securing tile roof to the substructure along a line or zone between the eave and the ridge line. The roof panels are allowed to expand lengthwise from the midline toward both the eave and the ridge. At the ridge, they are covered by a conventional cap.

BRIEF DESCRIPTION OF THE DRAWINGS

In the accompanying drawings.

DESCRIPTION OF THE PREFERRED EMBODIMENT

Figure 3:
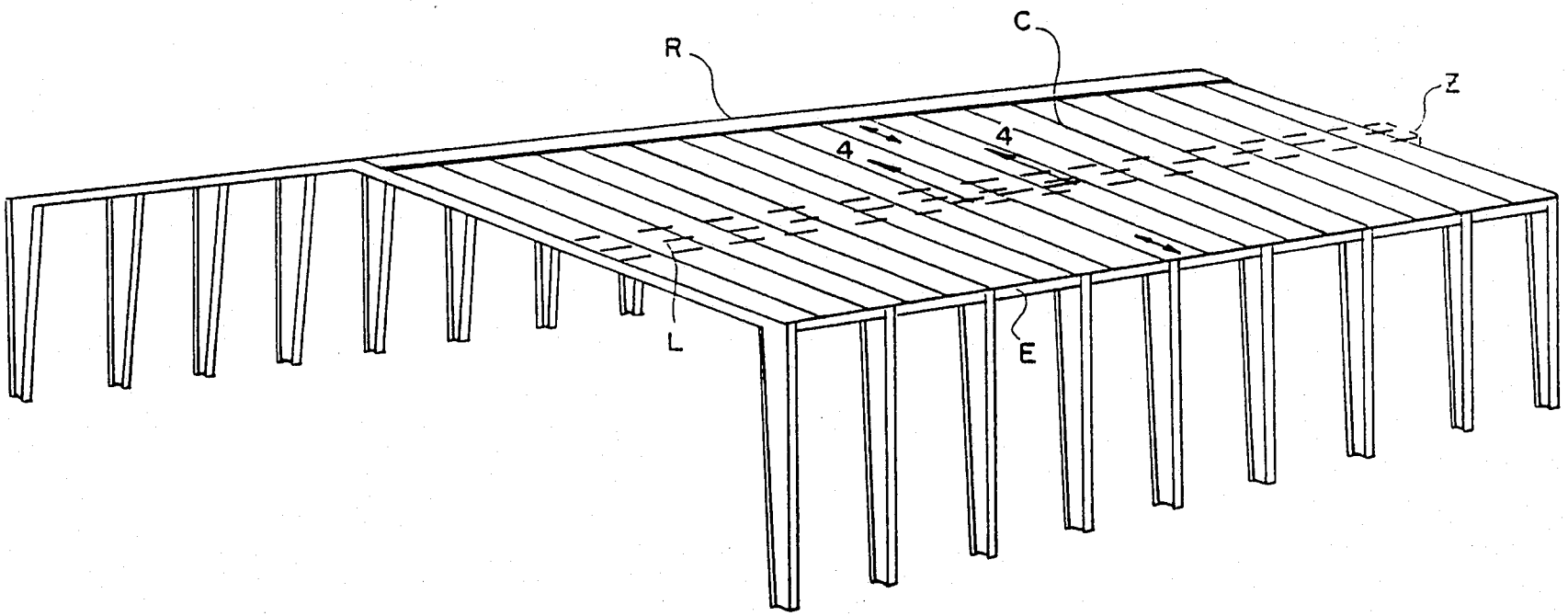
FIG. 3 is a view corresponding to FIG. 1, showing a building having a roof embodying the invention.

A roof covering embodying the invention is constructed on the substructure of a large building. A preferred roof covering, shown in FIG. 3, is built up from an array of conventional preformed metal panels interconnected by seaming.

In order to fix the roof to the substructure, a series of anchoring channels 40 (FIGS. 4–7), each having a U-section with arms 42, 44 bent inward to conform to the corrugation shape defined by the raised edges 46 of the roof panels, is affixed to the substructure. These channels are arranged, parallel to one another, along and transverse to a line "L" (FIG. 3) intermediate the roof ridge and the eave, preferably at the midpoint of the roof. Each channel is securely attached to the substructure by self-threading bolts 48 or other fasteners having adequate strength to withstand the lateral loading on the roof. Once the channels are installed, fasteners such as self-tapping screws or bolts 50 are passed through both the panel corrugations and prepunched holes in the channel flanges. In the claims below, "immovably affixed" is intended to cover bolts, rivets, welds, or other fastenings which prevent any relative motion between the secured parts.

The roof covering "C" is immovably affixed to the substructure only in the zone "Z" containing the anchoring channels. In the presently preferred construction, the zone is about five feet wide (the length of each anchoring channel), and extends the width of the roof, from gable to gable. The zone may be wider or narrower, or even a line. In any event, however, it is very narrow in comparison to the roof. The meaning of "narrow" in the claims below will be apparent to people of skill in this field. Obviously, the covering cannot be immovably secured to the substructure over a very wide zone; buckling of the covering, overstressing the substructure, or failure of the connections could result.

Thermal expansion is problematic for a corrugated or seamed roof only in one direction: with the corrugations or seams. The corrugations flex sufficiently to absorb transverse expansion. In a seamed metal roof, which typically has some slope for water runoff, the seams normally run with the slope of the roof; thus, only expansion in the direction of the ridge "R" and eave "E" is of concern. To permit such expansion, the anchoring channels are attached across a narrow zone perpendicular to the corrugations, preferably midway between the ridge and the eave, so that the opposite forces acting on the anchoring channel are approximately equal. In most buildings, the ridge and eave constitute parallel upper and lower edges of the roof, and the zone is parallel to both of those edges. However, certain roofs may have non-parallel, non-intersecting edges, in which case the zone runs between them.

Figure 1:
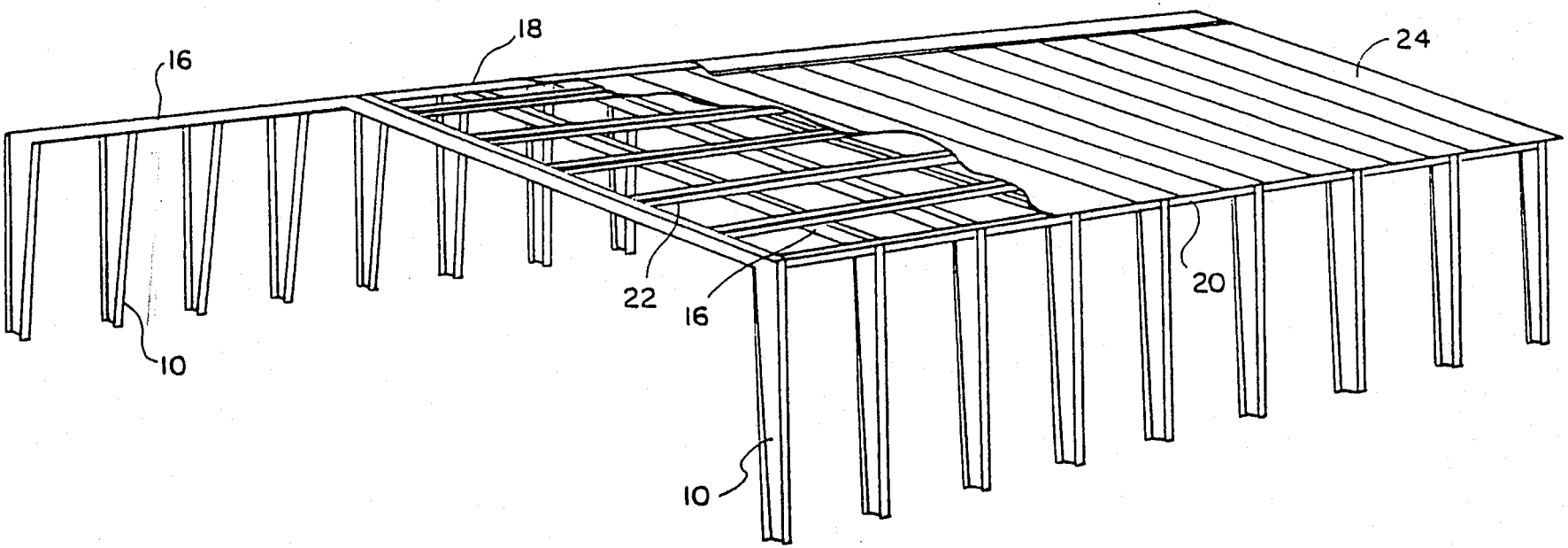
FIG. 1 is an isometric view of a building, including a roof substructure.
Figure 2:
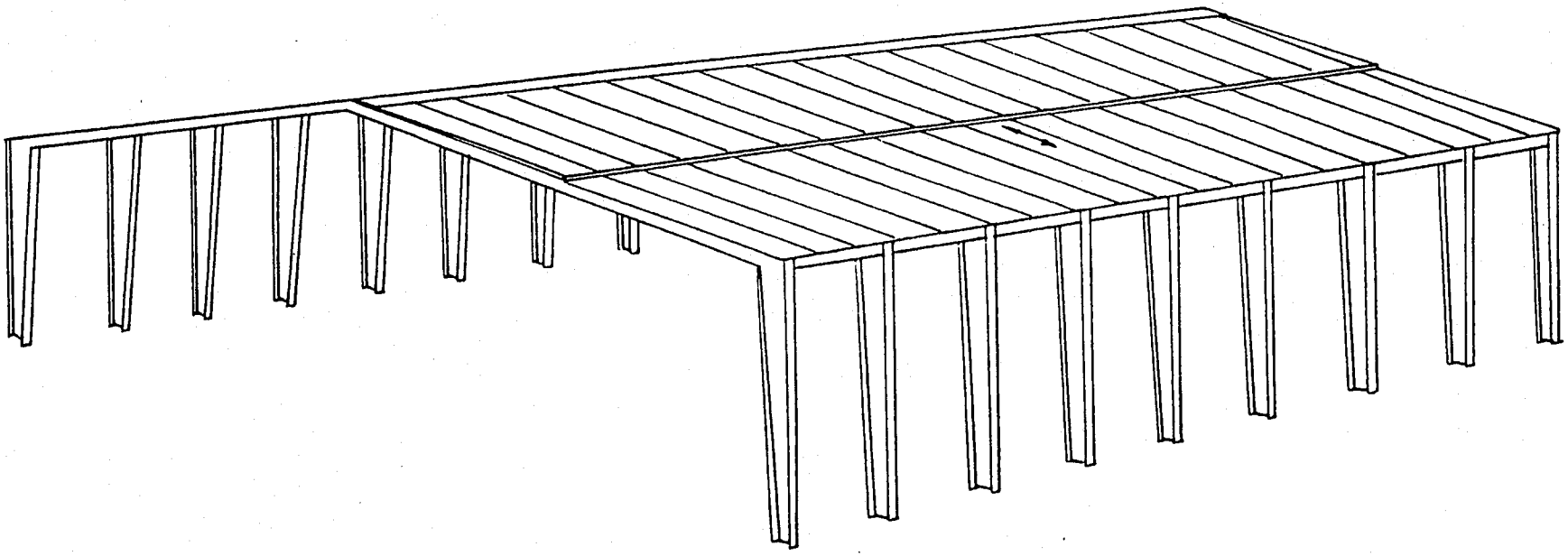
FIG. 2 shows a building having a stepped roof.
Figure 4:
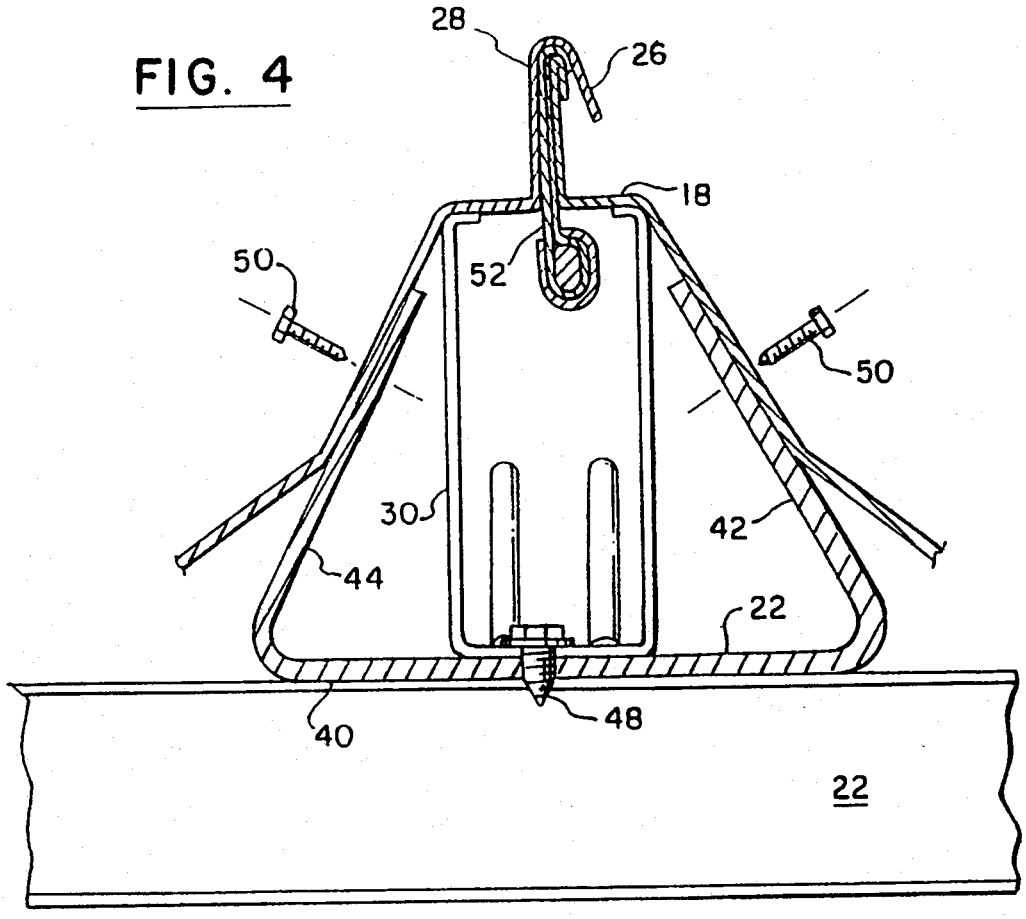
FIG. 4 is a sectional view, taken along the plane 4—4 in FIG. 3.
Figure 7:
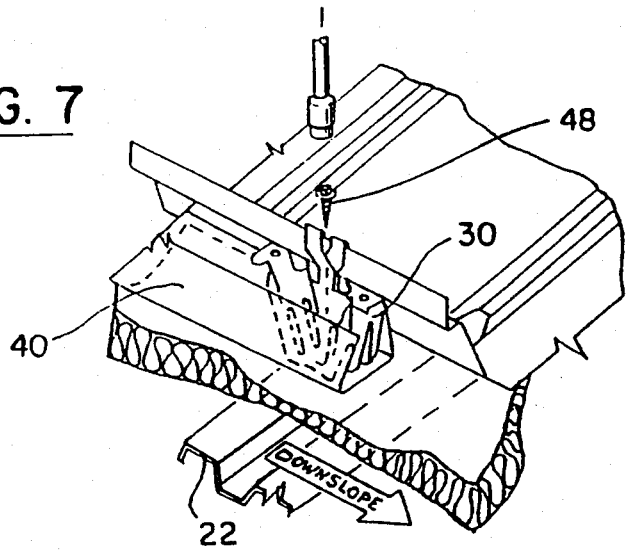
FIG. 7 is a partial isometric view showing the channel being secured to the substructure.

The channels are installed concurrently with installation of the metal panels on the substructure, beginning along one gable. A preferred way of installing the anchoring channels is illustrated in FIGS. 5–7.

Figure 5:
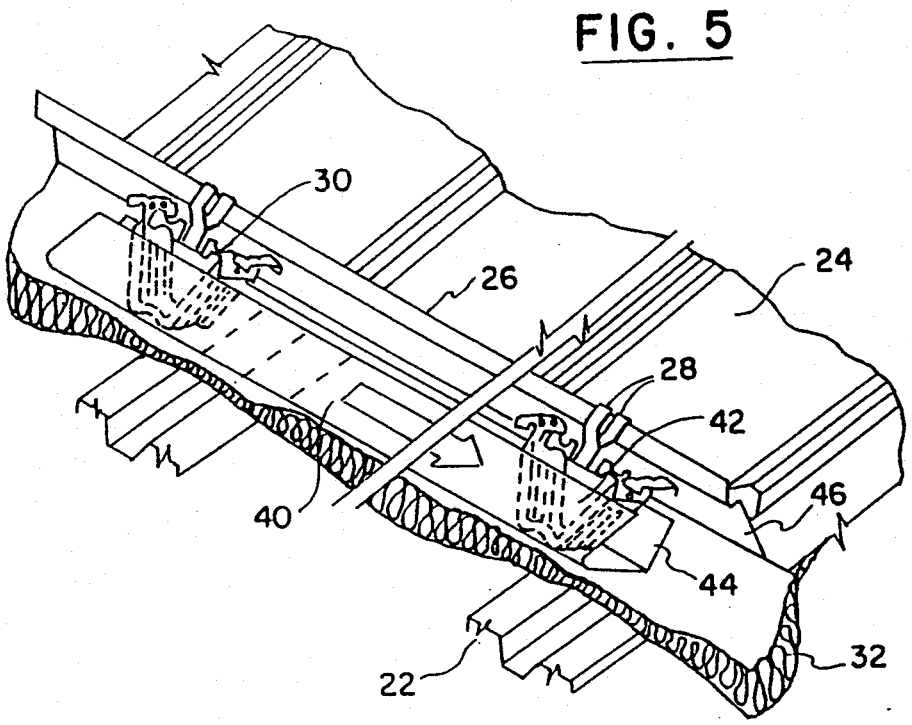
FIG. 5 is a partial isometric view, showing an anchoring channel being slid over panel attachment clips.

FIG. 5 shows an exposed side of a panel having a vertical flange which functions as the male side of a lap connection. The female side of an adjoining panel can be seen in FIG. 4. After the panel is in position, a number of attachment clips are hung from the vertical flange, at intervals corresponding to purlin spacing. FIG. 5 shows two such clips, at a spacing of about four feet. Once the clips are approximately positioned, an anchoring channel is slid lengthwise over them. The clips are tilted substantially out of a vertical plane, as shown, to facilitate this step.

Figure 6:
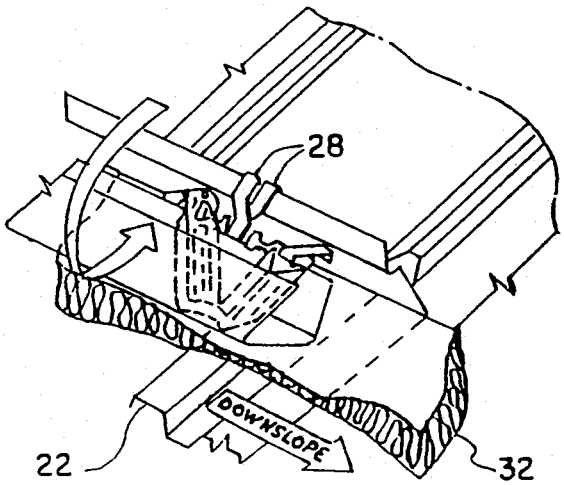
FIG. 6 is a partial isometric view showing the channel being rotated into position.

Once the channel is over both clips, it is then rotated, as suggested by the curved arrow in FIG. 6, until is laterally abuts the underside of the beveled portion of the panel edge. Now the clips are in a vertical plane of symmetry of the anchoring channel. Finally, the bottom holes of the clips are aligned with corresponding holes in the anchoring channel and purlin (preferably pre-perforated), and a self-tapping bolt is applied through the aligned holes.

The method described above is presently preferred; however, other assembly procedures may be used in practicing this invention.

The above description contemplates the invention in the context of a ridged roof. It should be apparent, however, that the principle of the invention can be applied to a single-slope roof, that is, one lacking a ridge. Since the invention is subject to this and other modifications and variations, it is intended that the foregoing description and the accompanying drawings shall be interpreted as illustrative of only one form of the invention, whose scope is to be measured by the following claims.

I claim:

1. A method of securing a metal roof covering to a roof substructure in such a way as to minimize thermally induced movement of the covering, comprising a step of immovably fixing the roof covering to the substructure only within a zone which is a narrow area on either side of a line extending intermediate two nonintersecting edges of the roof.

2. The method of claim 1, wherein the line is parallel to at least one edge of the roof.

3. The method of claim 1, wherein the line is parallel to two edges of the roof.

4. The method of claim 3, wherein the line is approximately midway between said two edges.

5. The method of claim 4, wherein the roof is sloped and has a ridge, one of said edges is an eave of the roof, and one of said edges runs along said ridge.

* * * * *